US005516299A

United States Patent [19]

Fukuda et al.

[11] Patent Number: 5,516,299

[45] Date of Patent: May 14, 1996

[54] MULTI-INPUT CONNECTOR

[75] Inventors: Masaru Fukuda; Motoyoshi Suzuki, both of Shizuoka, Japan

[73] Assignee: Yazaki Corporation, Japan

[21] Appl. No.: 162,614

[22] Filed: Dec. 7, 1993

[30] Foreign Application Priority Data

Dec. 7, 1992 [JP] Japan ..... 4-326892

[51] Int. Cl.[6] ..... H01R 13/703

[52] U.S. Cl. ..... 439/188; 200/51.1

[58] Field of Search ..... 439/188; 200/51.1

[56] References Cited

U.S. PATENT DOCUMENTS

| | | | |
|---|---|---|---|
| 4,582,376 | 4/1986 | Olsson | 439/514 |
| 5,259,776 | 11/1993 | Giroux | 439/188 |

FOREIGN PATENT DOCUMENTS

| | | | |
|---|---|---|---|
| 2903896 | 8/1979 | Germany | 439/188 |
| 53-28290 | 3/1978 | Japan . | |
| 54-37970 | 11/1979 | Japan . | |
| 62-64082 | 3/1987 | Japan . | |
| 2-170375 | 7/1990 | Japan . | |

*Primary Examiner*—Neil Abrams
*Attorney, Agent, or Firm*—Wigman, Cohen, Leitner & Myers

[57] ABSTRACT

A multi-input first connector for use with a mating connector wherein the first connector includes a connector housing; first, second, third, and fourth terminals disposed in the connector housing; a first connecting device for connecting the first terminal with the second terminal; a second connecting device for connecting the third terminal with the fourth terminal; and a connect-and-disconnect device. The connect-and-disconnect device connects a first terminal group with a second terminal group in a first state in which the mating connector is uncoupled from the first connector, and for disconnecting the first terminal group from the second terminal group in a second state in which the first connector is coupled together with the mating connector. An intrusive insulating portion of the mating connector disconnects the terminal groups by electrically separating them in the coupled state. The first terminal group includes a plurality of terminals including at least the first and second terminals, and the second terminal group includes a plurality of terminals including at least the third and fourth terminals.

9 Claims, 8 Drawing Sheets

MULTI-INPUT CONNECTOR

BACKGROUND OF THE INVENTION

1. Technical Field

The present invention relates to a multi-input connector which is used, for example, for air bags of automobiles and responsive to either signal derived from two sensors using both terminal shorting function and jointing function.

2. Background Art

FIG. 1 is a perspective view showing a conventional connector disclosed in Japanese Utility Model Registration Application for Publication No.54-37970, and FIGS. 2 show a cross-section taken along the line II—II of FIG. 1.

As shown in FIG. 1, connector 65 is constructed with male connector 67 containing a pair of tubular female terminals 66, 66 and another male connector 69 containing a pair of pin-like male terminals 68, 68 respectively corresponding to the female terminals 66. Each female terminal 66 has spring-type contact piece 72 projecting outward from opening 71 of male connector housing 70. The contact piece 72 contacts, as shown in FIG. 2(*a*), with metal shield 73 covering the housing 70 to prevent bad situation (e.g., igniting of air bag in automobile) to be caused by static electricity or the like reason in the connector uncoupling state. In the connector coupling state, as shown in FIG. 2(*b*), the contact piece 72 is insulated from the metal shield 73 by interruption of wall plate 75 of female connector housing 74.

In case of such a conventional connector 65, however, two connectors 65 must be prepared for using two sensors in, for example, an air bag of automobile and igniting it by a signal from either one of these sensors. Therefore, such a case by such a conventional connector has been troublesome in the connection and maintenance works and inefficient because of requiring a relatively large installation space.

SUMMARY OF THE INVENTION

It is an object of the present invention to provide a multi-input connector which can connect two sensors in, for example, an air bag of automobile using only one connector, and is thus advantageous in the connection and maintenance works as well as in the installation space and manufacturing cost.

To achieve the above object, the present invention provides a multi-input connector. This multi-input connector includes a connector housing; first, second, third and fourth terminals provided for the connector housing; first connecting device for connecting the first terminal with the second terminal; second connecting device for connecting the third terminal with the fourth terminal; and third connecting device. The third connecting device is for connecting a first terminal group with a second terminal group in the uncoupling state of the connector and for insulating the first terminal group from said second terminal group in the coupling state of the connector. The first terminal group includes the first terminal and the second terminal, the second terminal group includes the third terminal and the fourth terminal.

In the above multi-input connector, the first and second terminal groups are connected to each other by the third connecting means in the connector uncoupling state to prevent bad influence from static electricity or the like factor. Moreover, these first and second terminal groups are insulated from each other by the third connecting means in the connector coupling state to make the input from two sensors to each of the first and second terminal groups connectable at the same time.

The present invention also provides a multi-input connector. This multi-input connector includes a first connector and a second connector to be connected with the first connector.

This first connector includes a first connector housing; fifth, sixth, seventh and eighth terminals provided for the first connector housing; fourth connecting device for connecting the fifth terminal with the sixth terminal; and fifth connecting device for connecting the seventh terminal with the eighth terminal.

This second connector includes a second connector housing to be coupled with the first connector housing; ninth, tenth, eleventh and twelfth terminals provided for the second connector housing. In the coupling state of the connector the ninth terminal is connected with the fifth terminal, the tenth terminal is connected with the sixth terminal, the eleventh terminal is connected with the seventh terminal, and the twelfth terminal is connected with the eighth terminal.

This second connector further includes sixth connecting device for connecting a third terminal group with a fourth terminal group in the uncoupling state of the connector and for insulating the third terminal group with the fourth terminal group in the coupling state of the connector. The third terminal group includes the ninth terminal and the tenth terminal, the fourth terminal group includes the eleventh terminal and twelfth terminals.

In the above multi-input connector, the third and fourth terminal groups are connected to each other by the sixth connecting means in the connector uncoupling state to prevent bad influence caused by static electricity or the like factor. Moreover, these third and fourth terminal groups are insulated from each other by that sixth connecting means in the connector coupling state. In that case, since the fifth and sixth terminals in the first connector housing are connected to each other by the fourth connecting means and the seventh and eighth terminals are connected to each other by the fifth connecting means, the input from two sensors can be connected at the same time by one connector through the other connector.

These and other objects, features and advantages of the present invention will be more apparent from the following description of a preferred embodiment, taken in conjunction with the accompanying drawings.

DESCRIPTION OF THE PREFERRED EMBODIMENT

First Embodiment

Figure 1:
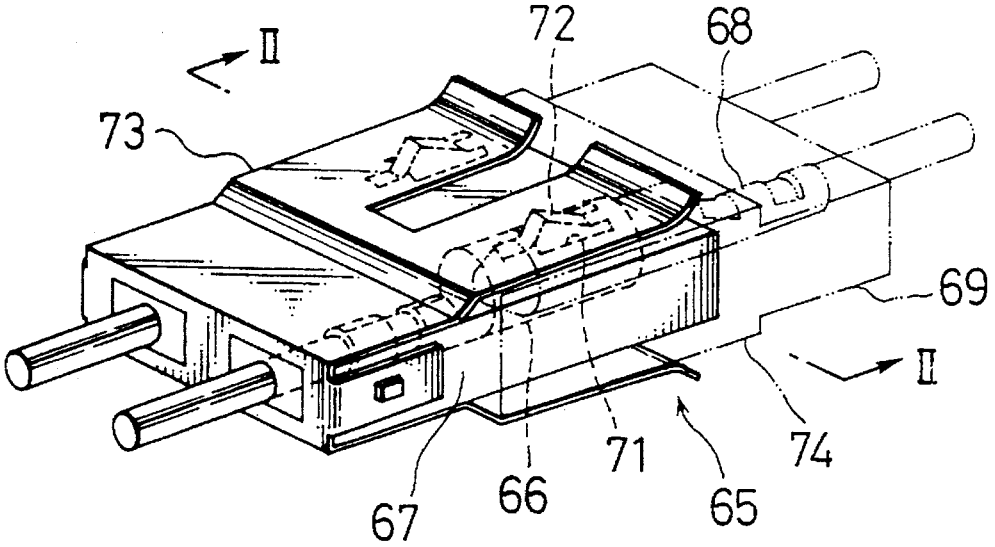
FIG. 1 PRIOR ART
FIG. 1A is a perspective view showing an example of the prior art.
Figure 2A:
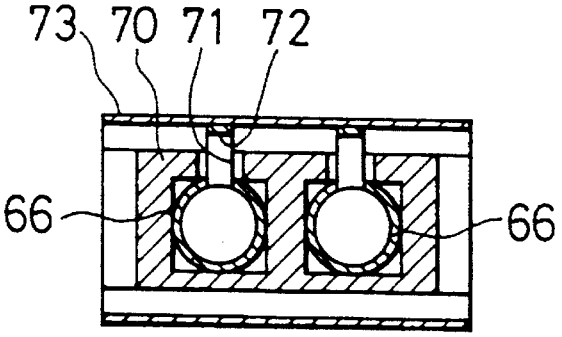
FIG. 2A PRIOR ART
FIGS. 2 show a cross-section of the line II—II in FIG. 1, in which FIG. 2(*a*) shows a state before connector coupling, while FIG. 2(*b*) shows a state after connector coupling.
Figure 2B:
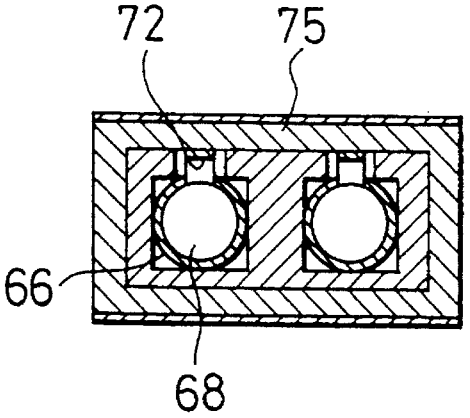
FIG. 2B PRIOR ART
Figure 3:
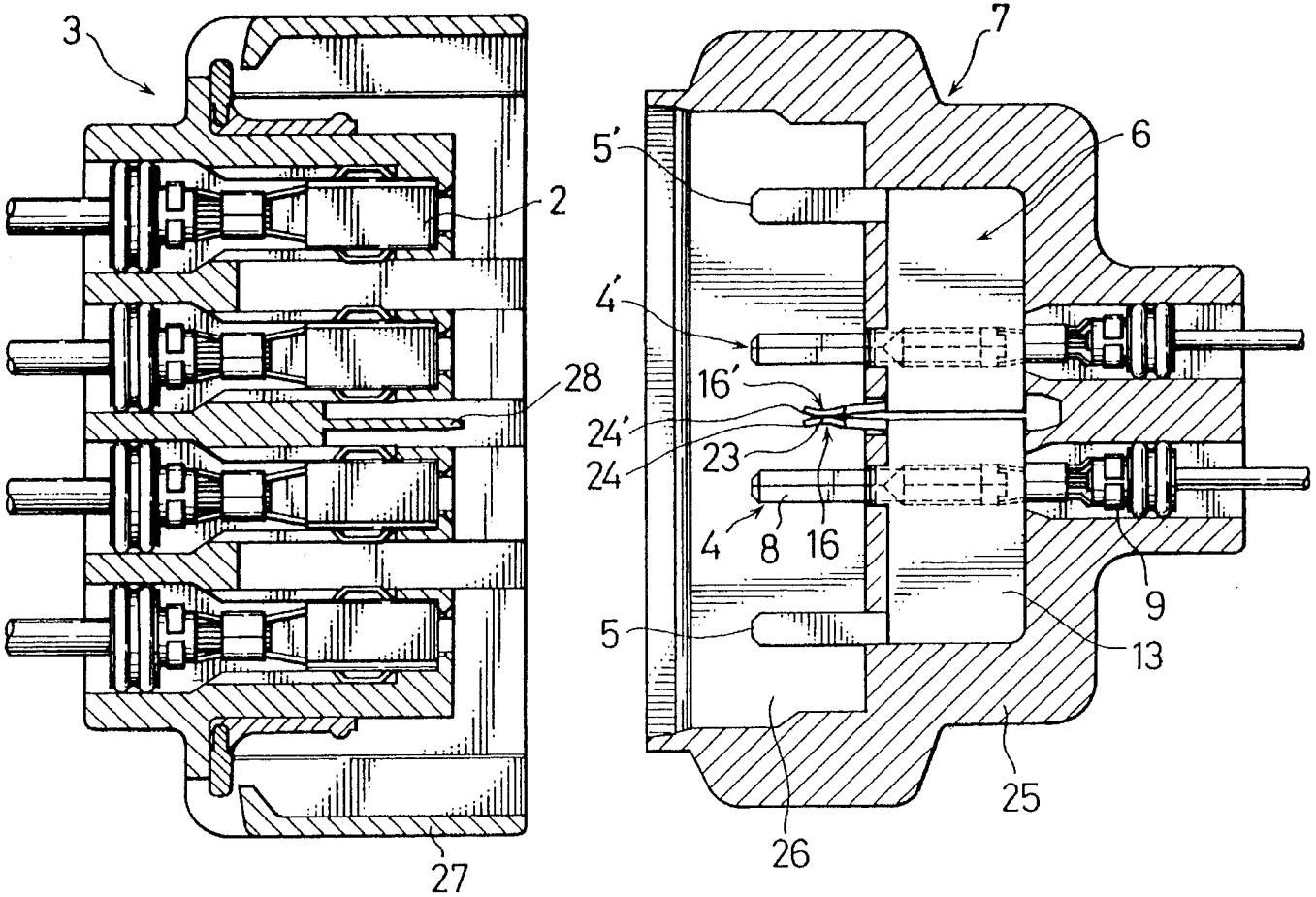
FIG. 3 is a horizontal cross-section showing an uncoupling state of a first embodiment of multi-input connector according to the present invention.
Figure 4:
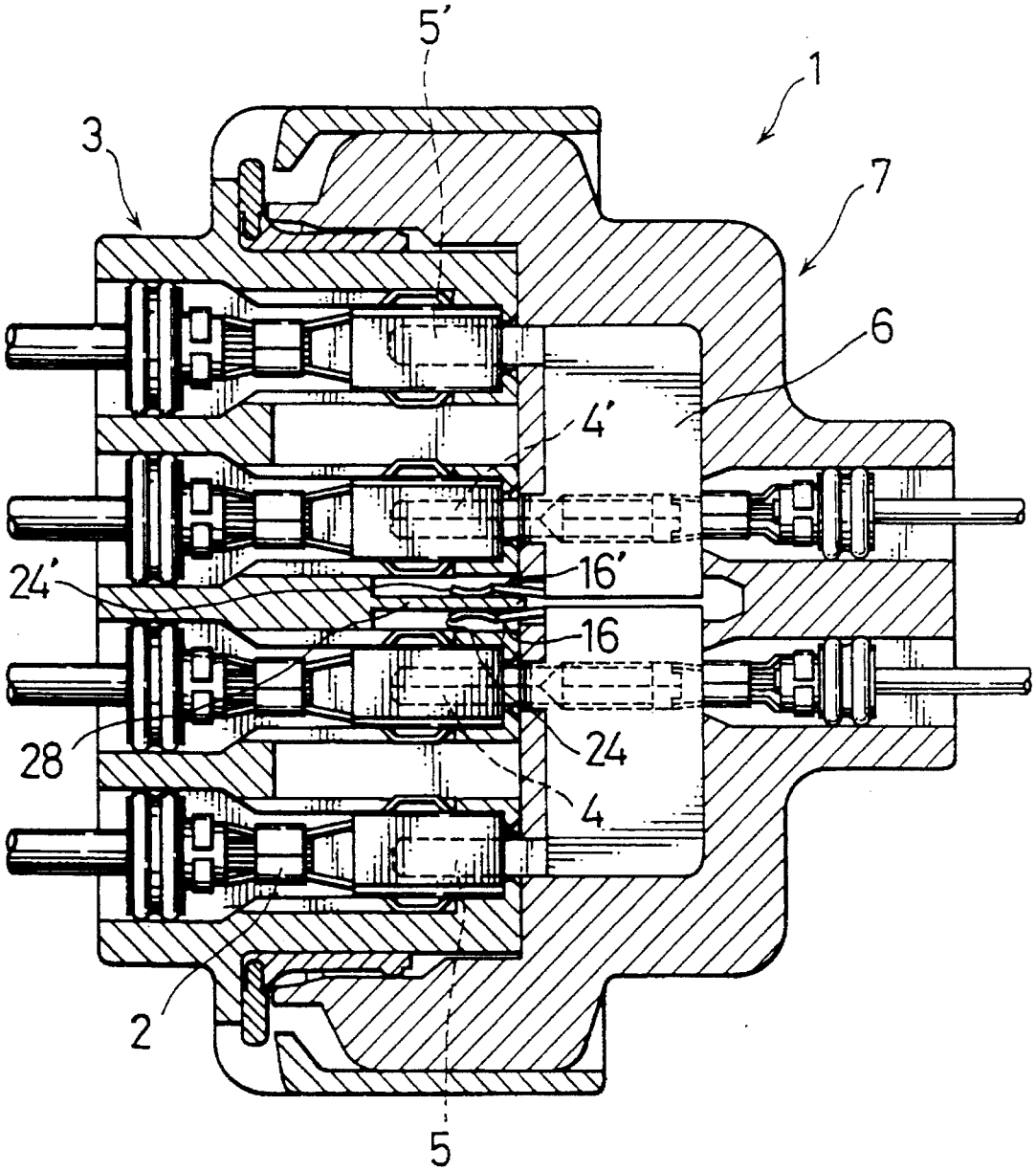
FIG. 4 is a horizontal cross-section showing a coupling state of the same multi-input connector as shown in FIG. 3
Figure 5:
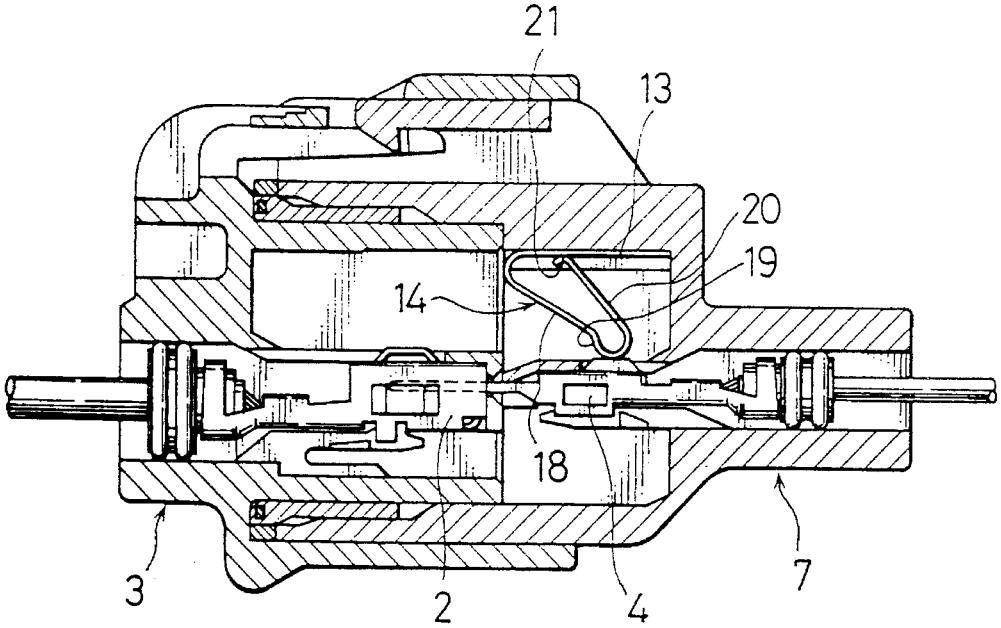
FIG. 5 is a vertical cross-section showing a coupling state of the same multi-input connector as shown in FIG. 3.

FIG. 3 is a horizontal cross-section showing a first embodiment of multi-input connector according to the present invention, and FIGS. 4 and 5 are horizontal and vertical cross-sections showing a coupling state of the same connector.

Multi-input connector system 1 is constructed with male connector 3 containing four female terminals 2 for connecting input derived from two sensors (not shown) in an air bag for use in automobiles and female connector 7 containing joint terminal 6 having a shorting mechanism including two pairs of male terminals 4, 5, and 4', 5' corresponding to the male terminals 2.

Figure 6:
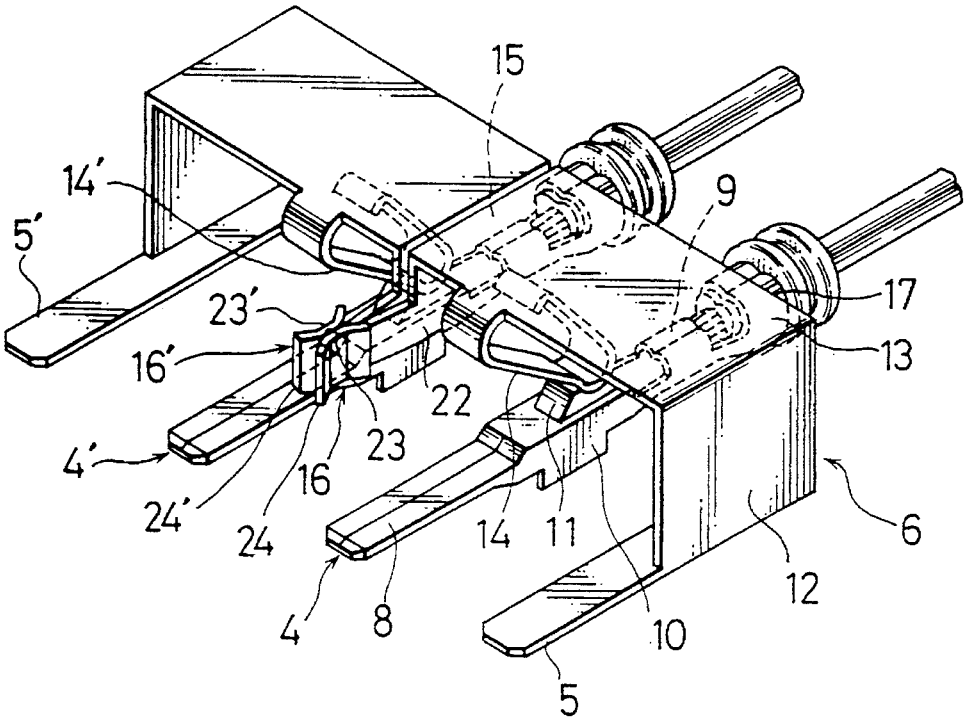
FIG. 6 is a perspective view of a joint terminal including a shorting mechanism contained in the multi-input connector shown in FIG. 3.

It should be noted that the most important portion of this embodiment is the connecting structure of joint terminal 6 having a shorting mechanism. That is, such a joint terminal 6 having a shorting mechanism is constructed, as shown in FIG. 6, by symmetrically arranging the two pairs of male terminals 4, 5, 4', 5' and a pair of shorting joint terminals 17, 17', respectively.

In more detail, the male terminal 4 has male tab 8 at its front end, wire connecting crimp portion 9 at its rear end and thick plate portion 10 including contact projection 11 at its intermediate portion. The male terminal 5 corresponding to the terminal 4 is formed as a planar tab terminal and arranged outside the terminal 4 in parallel. Further, the shorting joint terminal 17 includes side wall 12 rising at the outer edge of rear portion of male tab terminal 5, top plate 13 extending over the male terminal 4 from the top edge of side wall 12, first spring piece 14 extending downward corresponding to the contact projection 11 of male terminal 4 from the front edge of top plate 13 for shorting the corresponding circuit, wall plate 15 vertically falling at the inner edge of top plate 13, and contact portion 16 projecting forward from the side wall 15 to be used as joint.

As shown in FIG. 5, the first spring piece 14 includes front portion 18 extending from the front edge of top plate 13 toward the contact projection of male terminal 4, U-shaped contact portion 19 formed at the distal end of front portion 18, rear portion 20 extending from the contact portion 19 in substantially parallel with the front portion 18, and another U-shaped portion 21 formed at the distal end of rear portion 20 in contact with the bottom face of top plate 13.

Returning to FIG. 6, the contact portion 16 has base portion 22 extending from wall plate 15 substantially parallel to the male tab 8 and having a curved contact portion 23 at its front end. Further, the curved portion 23 has a guide portion 24 opening forward. A mirror-image joint terminal 6' confronts joint terminal 6 at the respective wall plates 15, 15' ; base plate portions 22, 22', and contact portions 16, 16 40 such that curved contact portions 23, 23' press against one another. Accordingly, in the pair of symmetric contact portions 16, 16 40 the curved contact portions 23, 23' contact with each other defining a front opening by their guide portions 24, 24 .

Moreover, as shown In FIG. 3, these contact portions 16, 16 ' project in contact with each other frontwards in connector coupling cavity 26 of female connector housing 25. On the other hand, in the mating male connector housing 27, wedge-like projection 28 is provided corresponding to the opening defined by guide portions 24, 24 of contact portions 16, 16'. Thus, in the coupling state of male and female connectors 3, 7 as shown in FIG. 4, the projection 28 opens the guide portions 24, 24 and enters between the contact portions 16, 16' to insulate them. Thus, the two pairs of male terminals 4, 5, 4', 5' are disconnected by projection 28 and divided into two pairs on groups of separately connected terminals 4, 5 and 4', 5'. In that case, the individual pairs of male terminals 4, 5 and 4', 5' are connected together through the spring piece 14 and 14', respectively.

Accordingly, in the connector uncoupling state, the contact portions 16, 16 40 contact each other and the two pairs of mate terminals 4, 5 and 4', 5' are shorted together, thereby preventing the priming of air bag as may generally be caused by static electricity.

Moreover, in the connector coupling state, input signals derived from two sensors are selectively received by each pair of male terminals 4, 5 or 4', 5' through the four female terminals 2 of male connector 3.

Figure 7:
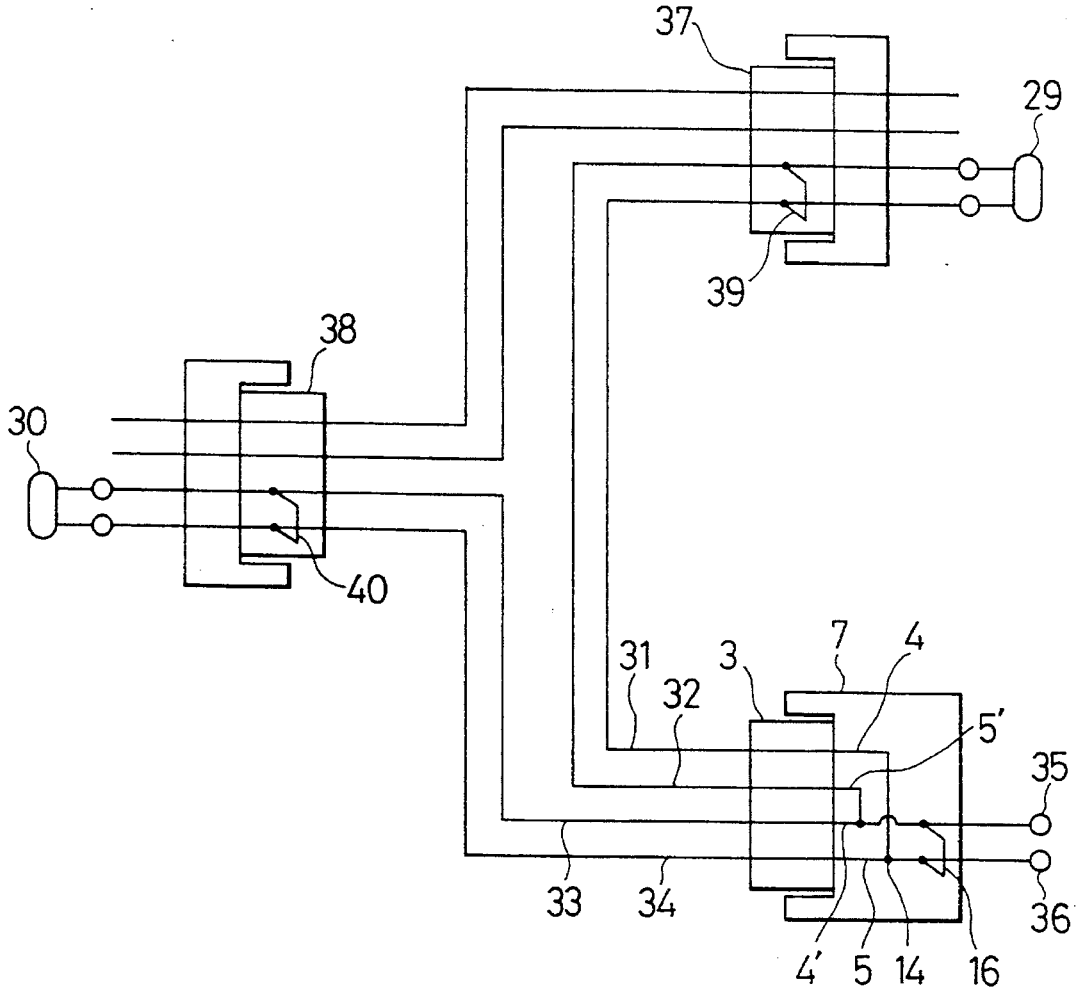
FIG. 7 is a circuit diagram for showing connection between two sensors and the multi-input connector shown in FIG. 3.

FIG. 7 is a circuit diagram showing connection between two sensors and the multi-input connector of this first embodiment. As shown in the same drawing, each pair of wires 31, 32 and 33, 34 derived from two sensors 29, 30 are connected with the male terminals 4, 5 and 4', 5' of female connector 7 through the male connector 3. In the connection between each wire and each male terminal, for example, 31 and 4, 32 and 4', and 35 and 5 are connected, respectively. Then, these wires are collected together into two circuit wires 35, 36 to be connected on the side of air bag. In the same drawing, reference numeral 16 denotes the contact portions provided in the female connector 7 having a shorting function for preventing bad influence of static electricity in the connector uncoupling state and constructed to be insulated in the connector coupling state. Such a shorting function (39, 40) is also provided in connectors 37, 38 on the side of two sensors.

Second Embodiment

Figure 8:
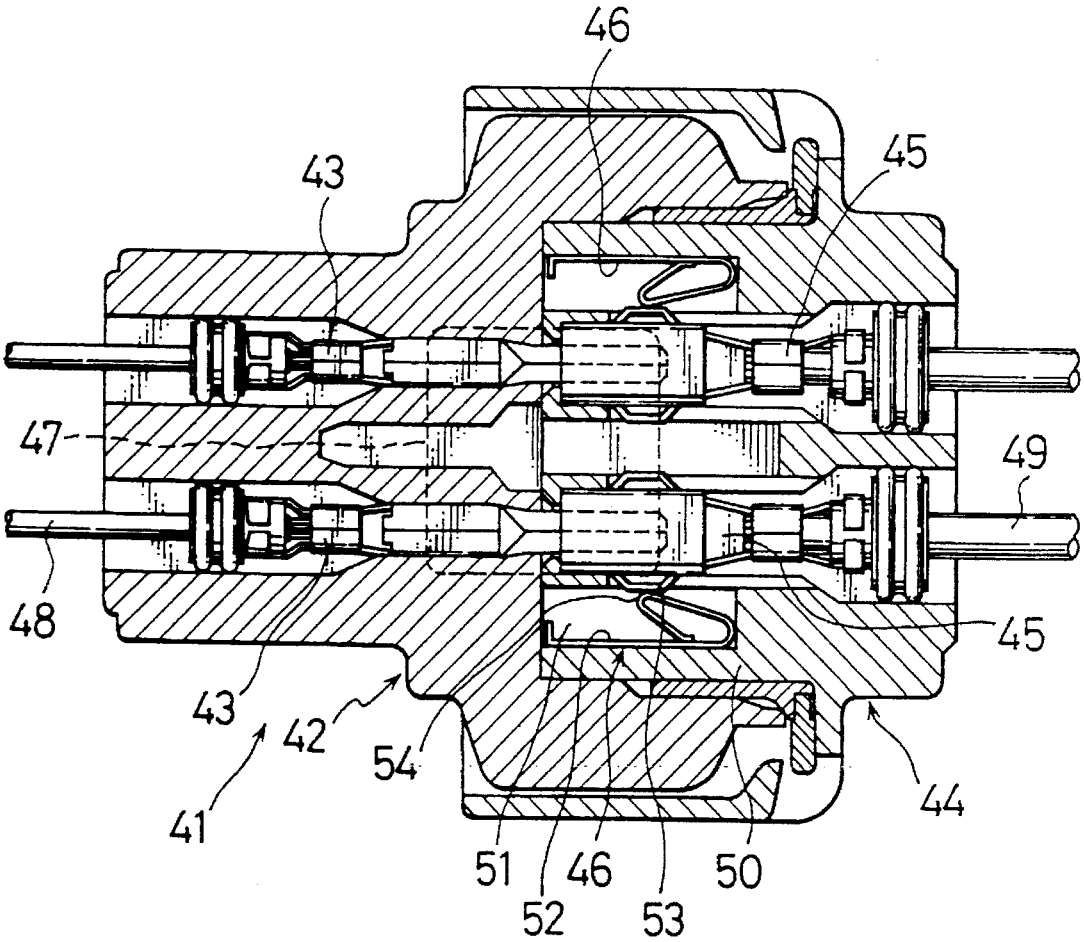
FIG. 8 is a horizontal cross-section showing a coupling state of a second embodiment of multi-input connector according to the present invention.
Figure 9:
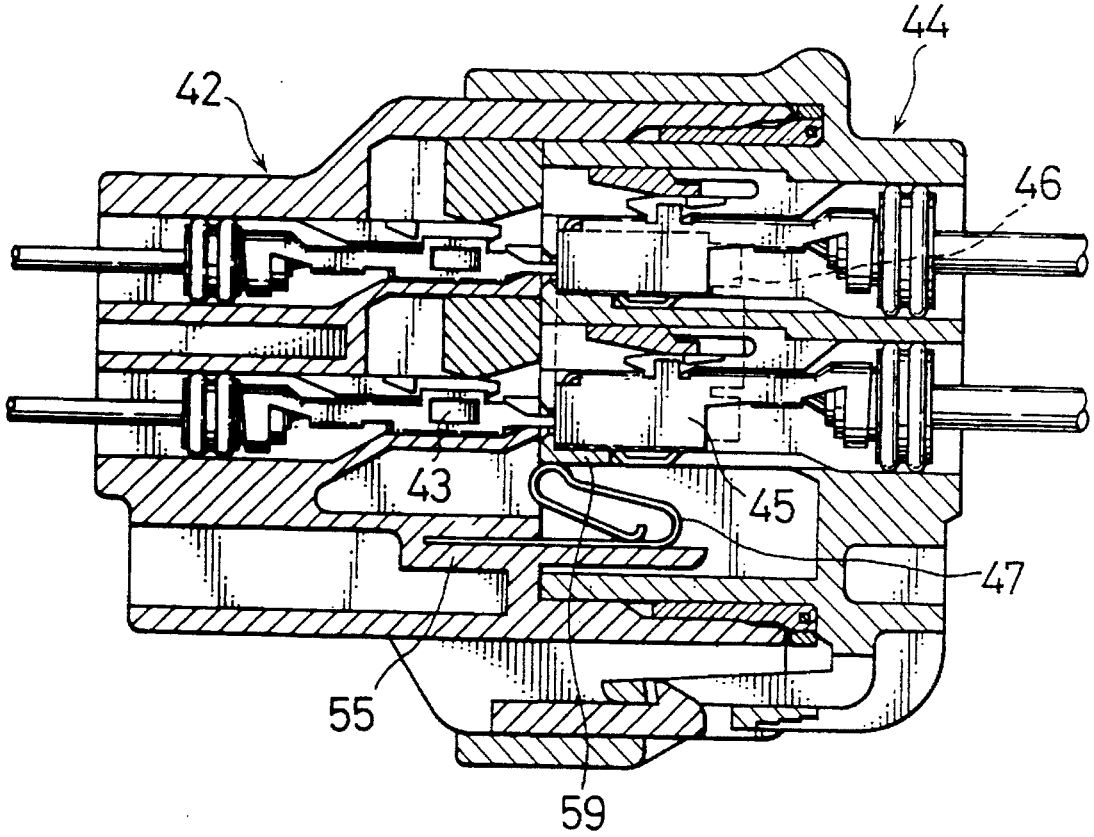
FIG. 9 is a vertical cross-section of the same multi-input connector as shown in FIG. 8.

FIG. 8 is a horizontal cross-section showing a second embodiment of the multi-input connector according to the present invention. FIG. 9 is a vertical cross-section of this first embodiment.

Multi-input connector system 41 as the second embodiment is characterized by comprising a pair of male terminals 43 disposed in female connector 42 and a pair of female terminals 45 disposed in male connector 44, a contact spring member 46 for joining the pair of female terminals (one each upper and lower) 45 in the male connector 44, and a contact spring member 47 for shorting the lower male terminal 43 (see FIG. 10) in the connector uncoupling state while insulating it in the connector coupling state, each of these four male terminals and female terminals being connected to wires 48, 49, respectively.

Figure 10:
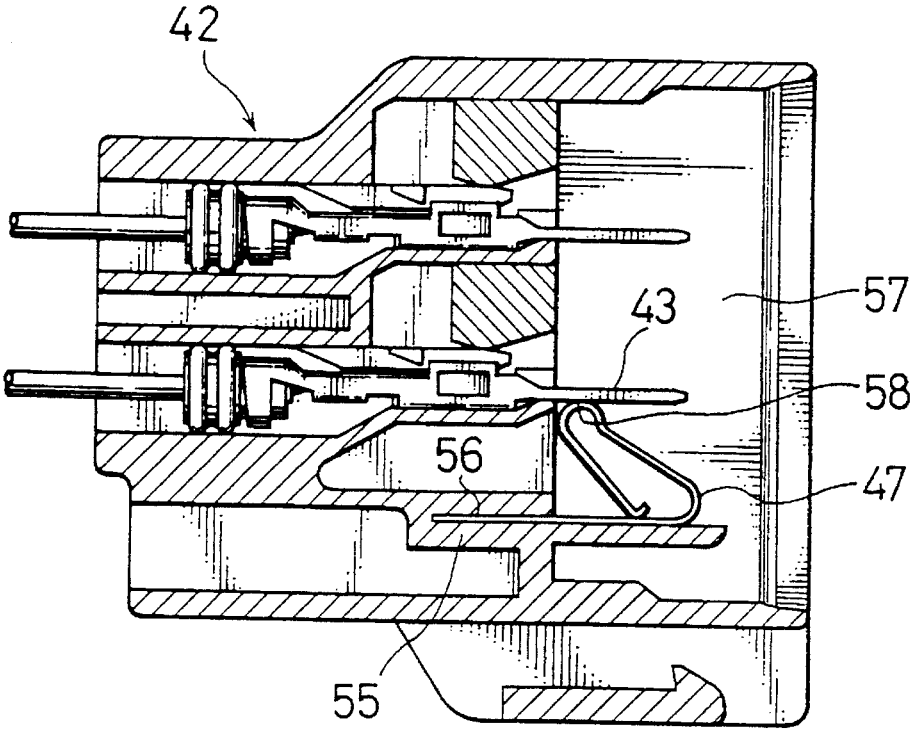
FIG. 10 is a vertical cross-section of the female connector in the same multi-input connector as shown in FIG. 8.

In this embodiment, the two contact spring members and contact spring member, 47 are disposed separately from the female terminals 45 and male terminals 43 as shown in FIGS. 8, 9, respectively. The configuration of these spring members 46, 47 is substantially the same as that of contact spring piece 14 in the first embodiment. Each of the two contact spring member 46 is fitted in corresponding longitudinal groove 51 of male connector housing 50 including base plate portion 52 extending along the groove 51 and contact portion 54 always contacting contact projection 53 of female terminal 45 projecting outward from the groove 51. On the other hand, the contact spring member 47 includes, as shown in FIG. 10, base plate portion 56 extending and fixed in a wall of the housing 55 of female connector 42 and contact portion 58 disposed in female connector 42 coupling cavity 57. In the case shown in FIG. 9 the contact portion 58 is separated and insulated from male terminal 43, by the outer wall 59 of male connector 44 housing 50 in the connector coupling state.

Figure 11:
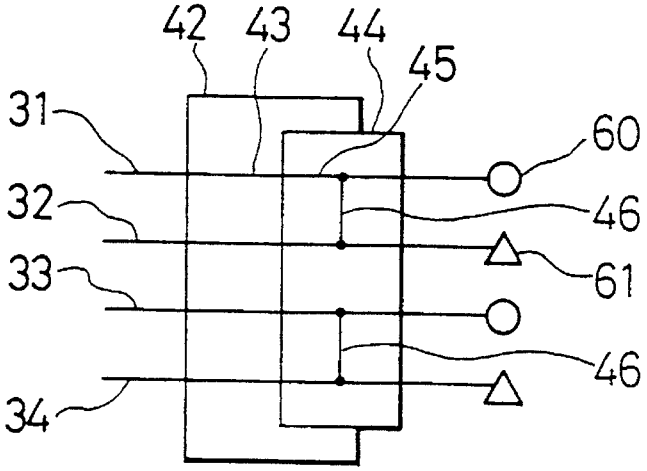
FIG. 11 is a circuit diagram for showing connection of the same multi-input connector as shown in FIG. 8.

FIG. 11 is a circuit diagram showing connection between two sensors and the multi-input connector of the second embodiment. As shown in the same drawing, each pair of wires 31, 32 and 33, 34 derived from two sensors are connected with the female terminals 45 of male connector 44 through the male terminal 43 of female connector 42. These wires are collected together into a pair of circuits by the effect of contact spring members 46, 46, and are then connected to each pair of two output wires 60, 61. Further, these output wires 60, 61 are divided to connect separately with, for example, air bags of driver's and assistant-driver's sheets.

As described in the first and second embodiments, according to the present invention, two sensors used, for example, for air bags of automobiles can be connected to only one connector by providing it with both shorting and jointing functions. Thus, the priming of two air bags can be controlled in response to either one of the signals derived from the two sensors without requiring two connectors as seen in the prior art. Therefore, this invention can facilitate the connection and maintenance works and reduce the installation space and manufacturing cost.

Various modifications will become possible for those skilled in the art after receiving the teachings of the present disclosure without departing from the scope thereof.

What is claimed is:

1. A multi-input connector system including a first connector for use with a mating connector, said first connector comprising:

a connector housing;

first and second respective pluralities of terminals disposed in said first connector housing;

a first connecting means for connecting together said first plurality of terminals to form a first terminal group;

a second connecting means for connecting together said second plurality of terminals to form a second terminal group; and selective connect-and-disconnect means for i) connecting the first terminal group together with the second terminal group in a first state in which the first connector is uncoupled from the mating connector and ii) for disconnecting said first terminal group from said second terminal group in a second state in which the first connector is coupled together with the mating connector, wherein each of said first and second connecting means includes a joint terminal comprising a first male contact having a proximal planar tab end extending to a distal end, a side wall joining said distal end and extending normal to said distal end, a wall plate parallel to said side wall, a planar top plate joining said side wall and said end wall, and a spring piece extending from said top plate to the plane of said first male contact tab end, wherein said first male contact, said side wall, said wall plate, said top plate, and said spring piece are formed as a single unit, and a second terminal is disposed parallel to and in the plane of the first male terminal tab end, said second terminal including a contact projection extending from the plane of said first and second terminals and adapted to contact said spring piece.

2. The multi-input connector system of claim 1, wherein said selective connect-and-disconnect means further comprises:

a first contact portion connected with said first terminal group; and a second contact portion connected with said second terminal group and pressing against said first contact portion in said first connector housing; and a first inserting-and-extracting means disposed on said mating connector positioned for insertion between said first contact portion and said second contact portion in the second state and to be extracted therefrom in the first state.

3. The multi-input connector system of claim 1, wherein said first connecting means includes a first contact projection and a first spring piece pressing against said first contact projection, and said second connecting means includes a second contact projection and a second spring piece pressing against said second contact projection.

4. The multi-input connector system of claim 1, wherein each of said first, second, third, and fourth terminals includes a wire termination portion adapted for connecting said termination to a wire.

5. A multi-input connector system, comprising:

a first connector having a housing; and a second connector having a housing mating with said first connector housing;

said first connector further including:

first, second, third, and fourth terminals disposed in said first connector housing;

first means for connecting together said first terminal with said second terminal;

second means for connecting together said third terminal with said fourth terminal;

said second connector including:

fifth and sixth, and seventh and eighth terminals disposed in said second connector housing and forming, respectively, first and second terminal groups, where in a first state the first and second connectors are coupled together, said fifth terminal is connected with said first terminal, said sixth terminal is connected with said second terminal, said seventh terminal is connected with said third terminal, and said eighth terminal is connected with said fourth terminal; and selective connect-and-disconnect means for i) connecting the first terminal group with the second terminal group in a second state wherein the first and second connectors are uncoupled and ii) for disconnecting said first terminal group from said second terminal group in the first state, wherein each of said first and second connecting means includes a joint terminal comprising a first male contact having a proximal planar tab end extending to a distal end, a side wall joining said distal end and extending normal to said distal end, a wall plate parallel to said side wall, a planar top plate joining said side wall and said end wall, and a spring piece extending from said top plate to the plane of said first male contact tab end, wherein said first male contact, said side walls said wall plate, said top plate, and said spring piece are formed as a single unit, and a second terminal is disposed parallel to and in the plane of the first male terminal tab end, said second terminal including a contact projection extending from the plane of said first and second terminals and adapted to contact said spring piece.

6. The multi-input connector system of claim 5 wherein said selective connection-and-disconnection means further comprises:

a first contact projection provided for said first terminal group;

a second contact projection provided for said second terminal group;

a first spring piece for pressing said first contact projection;

a second spring piece for pressing said second contact projection;

a first base plate for connecting said first spring piece with said second spring piece; and inserting-and-extracting means disposed on said first connector for insertion between said first spring piece and said first contact projection and between said second spring piece and said second contact projection in the first state, and to be extracted therefrom in the second state.

7. The multi-input connector system of claim 5 wherein:

said first connecting means includes a first contact projection provided for said first terminal, a third spring piece for pressing said third contact projection, a fourth contact projection provided for said second terminal, a fourth spring piece for pressing said fourth contact projection, and a second base plate for connecting said spring piece with said fourth spring piece; and said selective connect-and-disconnect means includes a fifth contact projection provided for said third terminal, a fifth spring piece for pressing said fifth contact projection, an sixth contact projection provided for said fourth terminal, a sixth spring piece for pressing said sixth contact projection, and a third base plate for connecting said fifth spring piece with said sixth spring piece.

8. The multi-input connector system of claim 5 wherein each of said first, second, third, and fourth and each of said fifth, sixth, seventh, and eighth terminals includes a wire termination portion adapted for connecting said termination to a wire.

9. A multi-input first connector system including a first connector for use with a mating connector, said first connector, comprising:

a connector housing;

first and second, and third and fourth terminals, respectively forming first and second pluralities of terminals disposed in said connector housing;

a first connecting means for connecting together said first plurality of terminals to form a first terminal group, comprising a plate integral with one of said first plurality of terminals and having thereon a spring means for disengageably joining said plate with another terminal of said first plurality of terminals;

a second connecting means for connecting together said second plurality of terminals to form a second terminal group, comprising a plate integral with one of said second plurality of terminals and having thereon a spring means for disengageably joining said plate with another terminal of said second plurality of terminals; and selective connect-and-disconnect means for i) joining the first terminal group together with the second terminal group in a first state in which the first connector is uncoupled from the mating connector and ii) for disconnecting said first terminal group from said second terminal group in a second state in which the first connector is coupled together with the mating connector;

wherein each of said first, second, third, and fourth terminals includes a wire termination portion adapted for connecting said termination to a wire.

* * * * *